US007493706B2

(12) United States Patent
Cho et al.

(10) Patent No.: US 7,493,706 B2
(45) Date of Patent: Feb. 24, 2009

(54) SHOE WITH CUSHION AND VENTILATION DEVICE

(76) Inventors: Jong Soo Cho, 158-29, Gamjeon-2 Dong, Sasang-Gu, Busan, 617-801 (KR); Hyeon San Jeong, 201, 1016-32, Guseo-2 Dong, Keumjung-Gu, Busan 609-802 (KR)

( * ) Notice: Subject to any disclaimer, the term of this patent is extended or adjusted under 35 U.S.C. 154(b) by 348 days.

(21) Appl. No.: 11/412,643

(22) Filed: Apr. 27, 2006

(65) Prior Publication Data

US 2007/0094890 A1 May 3, 2007

Related U.S. Application Data

(63) Continuation-in-part of application No. 11/265,663, filed on Nov. 2, 2005, now Pat. No. 7,254,903.

(51) Int. Cl.
*A43B 7/06* (2006.01)

(52) U.S. Cl. ..... 36/3 R; 36/3 B

(58) Field of Classification Search ..... 36/3 R, 36/3 B, 28, 29

See application file for complete search history.

(56) References Cited

U.S. PATENT DOCUMENTS 5,372,487 A * 12/1994 Pekar ..... 417/480
5,975,861 A * 11/1999 Shin et al. ..... 417/234
7,152,339 B2 * 12/2006 Lo ..... 36/3 R
7,171,765 B2 * 2/2007 Lo ..... 36/29
7,254,903 B2 * 8/2007 Cho et al. ..... 36/3 R
7,331,121 B2 * 2/2008 Lo ..... 36/3 R
2004/0010939 A1 * 1/2004 Liu et al. ..... 36/29
2005/0198862 A1 * 9/2005 Lo ..... 36/27
2005/0229432 A1 * 10/2005 Lo ..... 36/28
2006/0032089 A1 * 2/2006 Lo ..... 36/29
2006/0156575 A1 * 7/2006 Lo ..... 36/3 B

* cited by examiner

*Primary Examiner*—Marie Patterson
(74) *Attorney, Agent, or Firm*—Park & Associates IP Law LLC

(57) ABSTRACT

Provided is a shoe with a cushion and ventilation device. The cushion and ventilation device includes an air pump having an air discharge tube provided at its one side, and an air tube having a connection pipe connecting to the air discharge tube of the air pump, and an air chamber, wherein the air pump is provided by placing an upper sheet having a cavity on a lower sheet having an intake hole, and thermally bonding circumference surfaces of the upper and lower sheets using microwave, and wherein the upper and lower sheets further comprise a sponge having contraction and restoring forces therein.

18 Claims, 9 Drawing Sheets

SHOE WITH CUSHION AND VENTILATION DEVICE

CROSS-REFERENCE TO RELATED APPLICATIONS

The present application is a continuation-in-part of U.S. patent application Ser. No. 11/265,663 filed Nov. 2, 2005 which application is now U.S. Pat. No. 7,254,903. The present application claims priority of International Patent Application PCT/KR2005/000033 filed on Jan. 6, 2005.

FIELD OF THE INVENTION

The present invention relates to a shoe, and more particularly, to a shoe with a cushion and ventilation device, for enhancing a restoring force of an air pump for sucking air, and not only preventing an air passage from being closed in a thermal bonding process but also delaying a storage time of air stored in an air chamber to the maximum, thereby enhancing cushion force.

BACKGROUND OF THE INVENTION

As well known in the art, shoes for protecting walker's feet are manufactured using leather or synthetic resin that makes ventilation poor. Therefore, the shoes are not well air-circulated and thus, sweat or moisture causes bad smell and causes disease, such as athlete's foot or eczema, due to propagation of bacteria.

In order to solve the above problems, in recent years, a shoe with a ventilation device has been much suggested. In a schematic structure, the ventilation shoe includes a pump installed under a shoe sole and sucking air; a check valve for allowing one-way passage of the air sucked in the pump; and an air discharge tube connecting with the check valve and discharging the air passing through the check valve, into the shoe.

The conventional ventilation shoe having the above construction is clearly useful in that, in a walking motion, the air pump is repeatedly compressed and restored and performs a pumping operation, thereby continuously supplying external air into the shoe and effectively eliminating sweat or bad smell from the shoe. However, the conventional ventilation shoe has the following drawbacks.

First, in the conventional ventilation shoe, the air pump is compressed by pressure of foot and sucks air in the walking motion and then, when the pressure is not applied, is restored to an original state and discharges the sucked air into the discharge tube. The air pump is formed of elastic material to have cavity therein so that contraction and restoring operations can be performed. However, the above constructed air pump has a drawback in that, due to the long contraction and restoring operations, its elasticity is deteriorated and the restoring operation is not done well, thereby not providing a smooth pumping operation.

The conventional ventilation shoe has just only a ventilation function of circulating air in the shoe, and does not have a means for cushioning impact applied to the foot in the walking motion. Therefore, there is a drawback in that a walker easily feels tired due to the impact continuously applied to the foot in the walking motion.

SUMMARY OF THE INVENTION

Accordingly, the present invention is directed to a shoe with a cushion and ventilation device that substantially overcomes one or more of the limitations and disadvantages of the conventional art.

One object of the present invention is to provide a shoe with a cushion and ventilation device, for enhancing a restoring force of an air pump using a sponge installed within the air pump.

Another object of the present invention is to provide a shoe with a cushion and ventilation device, for enhancing a restoring force of a sponge and compensating crushed sponge in a contraction process, using an elastic member installed around the sponge.

A further another object of the present invention is to provide a shoe with a cushion and ventilation device, in which the cushion and ventilation device having an air pump, an air discharge tube, and an air pipe is manufactured in a one-time microwave based thermal bonding method.

A yet another object of the present invention is to provide a shoe with a cushion and ventilation device, for preventing an air passage of an air discharge pipe from being closed in a microwave thermal bonding process.

A still another object of the present invention is to provide a shoe with a cushion and ventilation device, for maximally delaying discharge of air stored in an air pipe into the shoe, thereby enhancing cushion force.

A still another object of the present invention is to provide a shoe with a cushion and ventilation device, for concentrating and supplying a discharged air to a sweaty portion.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims as well as the appended drawings.

To achieve the above and other objects and advantages, and in accordance with the purpose of the invention, as embodied and broadly described herein, there is provided a shoe with a cushion and ventilation device. The shoe includes uppers forming an external shape, and a sole forming a bottom of the uppers and having the cushion and ventilation device. The cushion and ventilation device includes an air pump having an air discharge tube provided at its one side, and an air tube having a connection pipe connecting to the air discharge tube of the air pump, and an air chamber, wherein the air pump is provided by placing an upper sheet having a cavity on a lower sheet having an intake hole, and thermally bonding circumference surfaces of the upper and lower sheets using microwave, and wherein the upper and lower sheets further comprise a sponge having contraction and restoring forces therein.

The upper and lower sheets may further comprise an elastic member placed on the sponge and having elastic protrusion parts extended along a circumference surface thereof.

An insulator formed of different material from the air tube may be fitted into an inlet port of the connection pipe provided at the air tube.

An auxiliary chamber for discharging air into the shoe may be partitioned by a thermal bonding part and provided in front of the air chamber, and the auxiliary chamber may communicate with a discharge passage provided at a center of the thermal bonding part.

The discharge passage may be narrowed as going from an inlet side to an outlet side.

The auxiliary chamber may be divided into a central auxiliary chamber communicating with the discharge passage, and side auxiliary chambers positioned at both sides of the central auxiliary chamber, and partitioned by auxiliary thermal bonding parts from the central auxiliary chamber and, in a partitioned state, communicating with the central auxiliary chamber through branch passages provided at the auxiliary thermal bonding parts.

The branch passages may be narrowed as going from the inlet side to the outlet side.

Spot thermal bonding parts may be bonded and provided in the central auxiliary chamber and the side auxiliary chambers.

The present invention relates to a shoe having ventilation and cushion functions, for repeatedly performing the ventilation and cushion functions using a human walking motion (motion for first making heels touch at the ground and next, making soles touch at the ground). The present invention is characterized in that an air pump is installed at the heel first touching at the ground in the walking motion and enhances its restoring force in a primary air suction process, and in that a storage time of air stored in an air chamber is delayed to the maximum, thereby providing a cushion force for cushioning impact applied to the sole, and in that a ventilation effect is embodied using air discharged little by little from the air chamber.

It is to be understood that both the foregoing summary and the following detailed description of the present invention are merely exemplary and intended for explanatory purposes only.

BRIEF DESCRIPTION OF THE DRAWINGS

The accompanying drawings, which are included to aid in understanding the invention and are incorporated into and constitute a part of this application, illustrate embodiment(s) of the invention and together with the description serve to explain the principles of the invention. In the drawings.

DETAILED DESCRIPTION OF THE INVENTION

Figure 1:
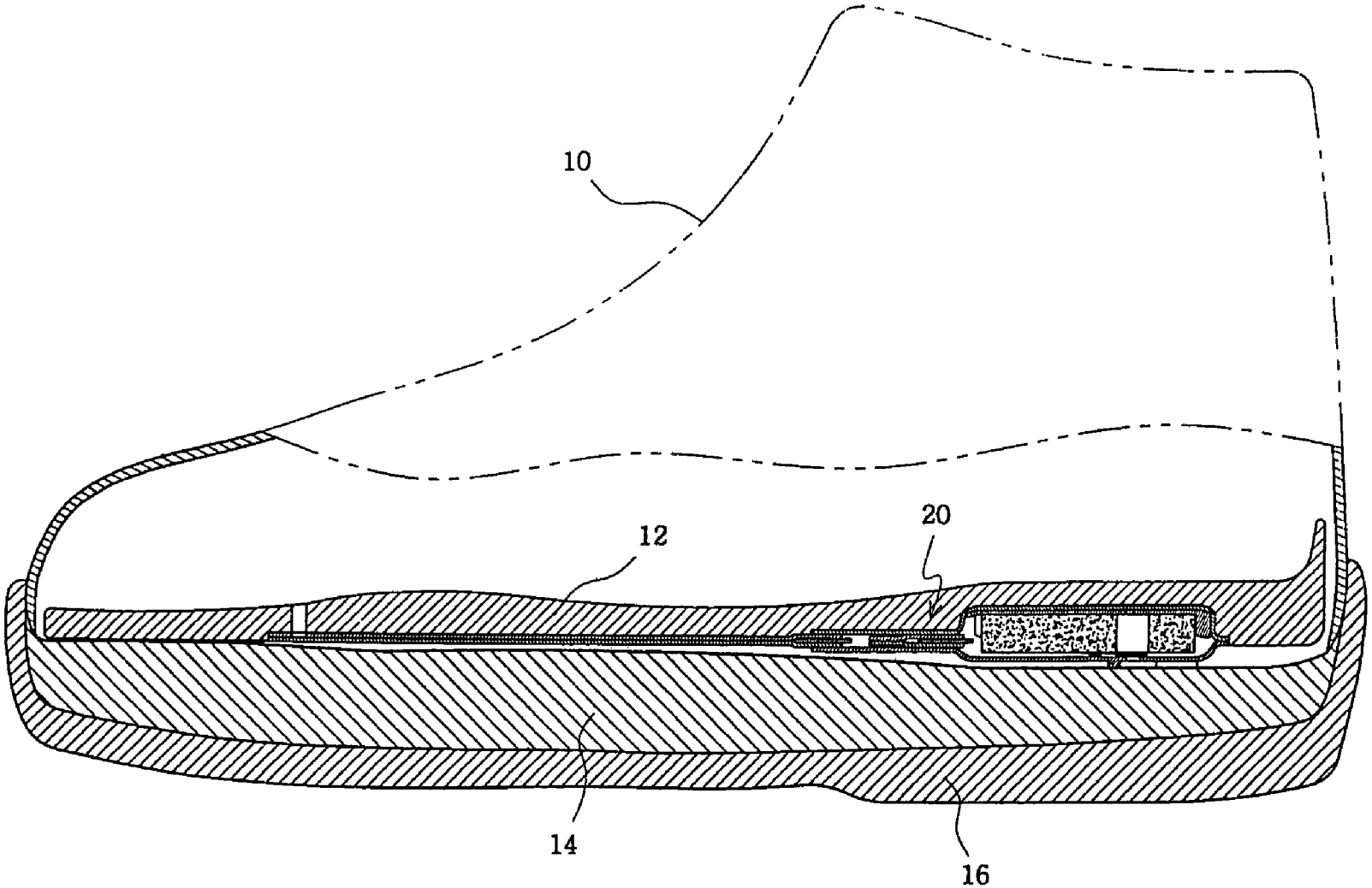
FIG. 1 is a sectional view illustrating a construction of a shoe with a cushion and ventilation device according to an exemplary embodiment of the present invention.

Reference will now be made in detail to the preferred embodiments of the present invention, examples of which are illustrated in the accompanying drawings. Wherever possible, the same reference numerals will be used throughout the drawings to refer to the same or like parts.

FIG. 1 illustrates a whole construction of a shoe with a cushion and ventilation device. As shown in FIG. 1, the shoe includes uppers 10 forming an external shape; and an in-sole 12, a mid-sole 14, and an out-sole 16 forming a bottom of the uppers 10.

The cushion and ventilation device 20, a main construction of the present invention, is installed under a bottom surface, preferably, under the in-sole 12 of the shoe 100. The following description will be made on the basis of limitation to the cushion and ventilation device 20 installed under the in-sole 12 but, in addition, the ventilation and cushion device 20 can be inserted into the mid-sole 14 in an insert injection method, or can be inserted between the mid-sole 14 and the out-sole 16. This will be easily understood by those having an ordinary knowledge in the art.

Figure 2:
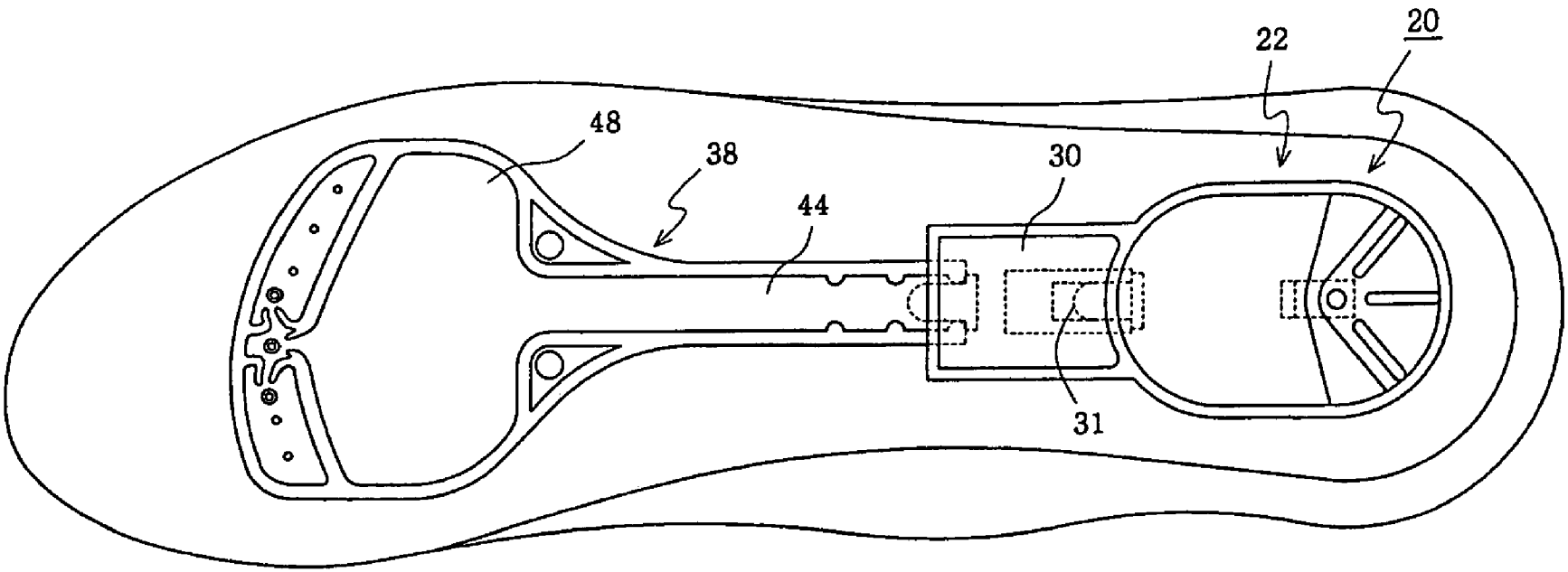
FIG. 2 is a plan view illustrating the cushion and ventilation device of FIG. 1.

FIG. 2 is a view illustrating the cushion and ventilation device 20.

As shown in FIG. 2, the cushion and ventilation device 20 includes an air pump 22 provided in its rear, and an air pipe 38 connecting to an air discharge tube 30 provided at the air pump 22, through a connection pipe 44. The air pump 22 sucks air from the external and discharges air to the air discharge tube 30, using contraction and restoration operations. The air discharged to the air discharge tube 30 passes through the connection pipe 44 and is stored in the air chamber 48 provided at the air pipe 38.

Figure 3:
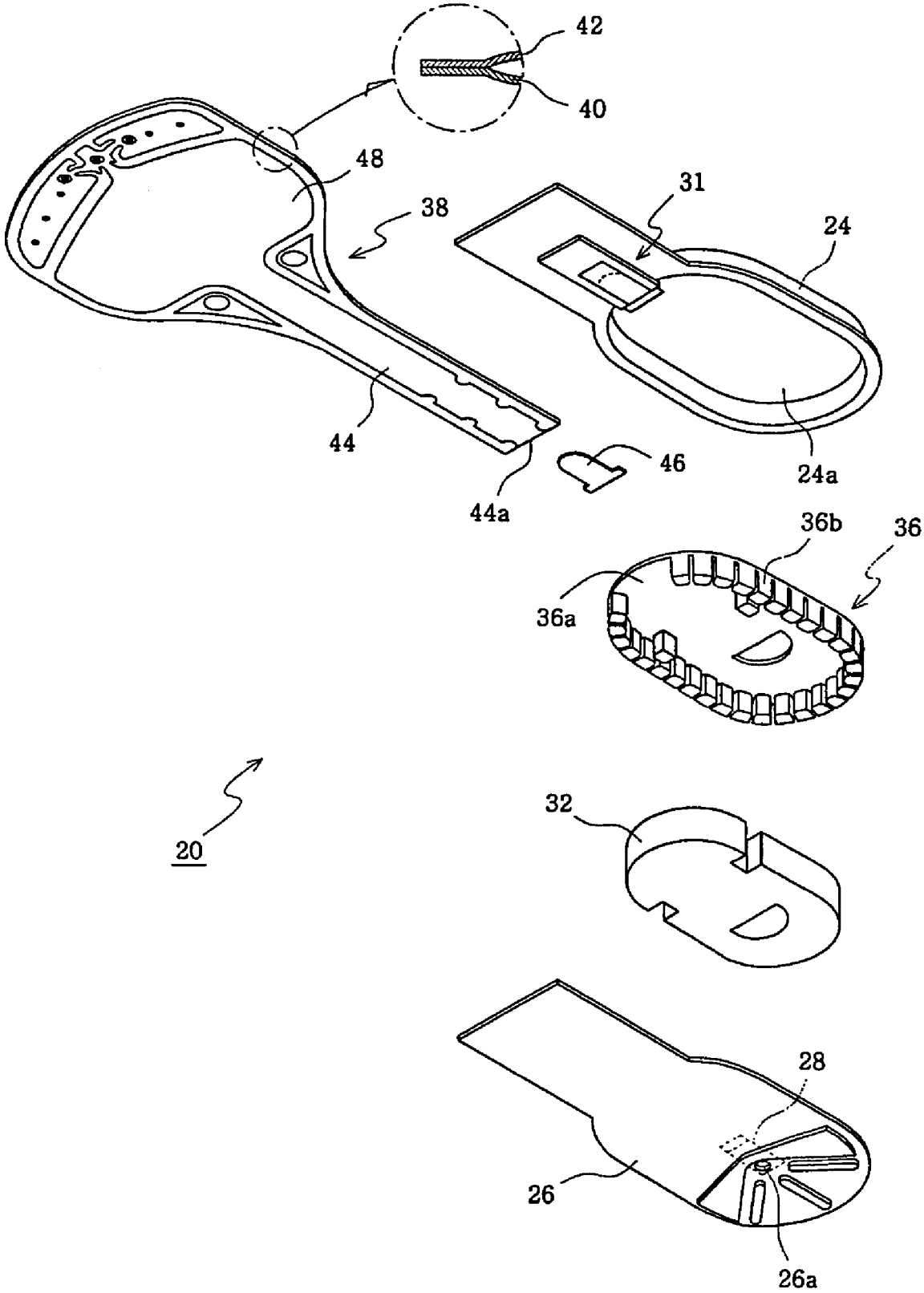
FIG. 3 is an exploded perspective view illustrating the cushion and ventilation device of FIG. 2.

FIG. 3 is a disassembled view illustrating a construction of the cushion and ventilation device 20.

As shown in FIG. 3, the air pump 22 includes an upper sheet 24 and a lower sheet 26.

The upper sheet 24 is formed of polyurethane (PU), and has a cavity part 24*a* provided at its center to have a predetermined size.

The lower sheet 26 is formed of polyurethane having the same physical property as the upper sheet 24. The lower sheet 26 is placed on the upper sheet 24, and is thermally bonded at its circumference surface, using microwave.

The lower sheet 26 has an intake hole 26*a* provided at its center. When the air pump 22 including the upper and lower sheets 24 and 26 is contracted, the intake hole 26*a* allows external air to be sucked into the cavity part 24*a* provided within the upper sheet 24.

The lower sheet 26 having the intake hole 26*a* has an elastic film 28 attached to an inner surface thereof. The elastic film 28 is elastically bent depending on pressure of the air sucked through the intake hole 26*a*. The elastic film 28 opens the intake hole 26*a* and, when air is sucked into the cavity part 24*a*, again closes the intake hole 26*a* using the pressure of the sucked air, thereby preventing the air from being discharged outside.

The air discharge tube 30 is integrally extended from one side of the air pump 22 including the upper and lower sheets 24 and 26 as described above. The air discharge tube 30 introduces the air sucked in the air pump 22 into the connection pipe 44 of the air pipe 38. The air discharge tube 30 has a valve 31 provided therein.

The air pump 22 has a sponge 32 provided therein. Before the upper and lower sheets 24 and 26 are thermally bonded, the sponge 32 is inserted into the cavity part 24*a* of the upper sheet 24. The sponge 32 increases a restoring force of the air pump 22, specifically, the upper sheet 24, by a self cushion force so that the air pump 22 is not damaged in its restoring force due to repetitive contraction and restoring operations (that is, pumping operation) of the air pump 22. Accordingly, the sponge 32 can prevent a pumping force of the air pump 22 from being deteriorated due to long time use.

A separate elastic member 36 is further provided on the sponge 32. The elastic member 36 is formed of elastic material such as a rubber. The elastic member 36 includes a plane part 36*a* and elastic protrusion parts 36*b*. The plane part 36*a* is adhered to an upper surface of the sponge 32, and the elastic protrusion parts 36*b* is protruded along a circumference surface of the plane part 36*a* and covers the circumference surface of the sponge 32. The elastic member 36 elastically enhances the restoring force of the sponge 32. Also, when the sponge 32 is not restored from its crushed state caused by the contraction process, the elastic protrusion parts 36*b* elastically compensate and restore the sponge 32.

The air tube 38 includes the connection pipe 44 provided between top and bottom sheets 40 and 42 and an air chamber 48 extended from the connection pipe 44. The connection pipe 44 and the air chamber 48 are provided by surface-contacting the top and bottom sheets 40 and 42 formed of polyurethane (PU) each other and thermally bonding the top and bottom sheets 40 and 42 at circumference surfaces thereof using microwave.

An insulator 46 formed of polyethylene (PE) or polypropylene (PP) is fitted into an inlet port 44*a* of the connection pipe 44. The insulator 46 prevents the inlet port 44*a* of the connection pipe 44 from being closed when the top and bottom sheets 40 and 42 are thermally bonded at their circumference surfaces.

In other words, as described above, the insulator 46 is formed of material (polypropylene) having a different physical property from the top and bottom sheets 40 and 42. Therefore, if the insulator 46 is fitted into the inlet port 44*a* of the connection pipe 44 and the top and bottom sheets 40 and 42 are thermally bonded at their whole circumference surfaces, parts of the top and bottom sheets 40 and 42 to which the insulator 46 is fitted are not in contact with each other and thus, are not thermally bonded. Accordingly, the inlet port 44*a* of the connection pipe 44 can be provided as opened.

Figure 7A:
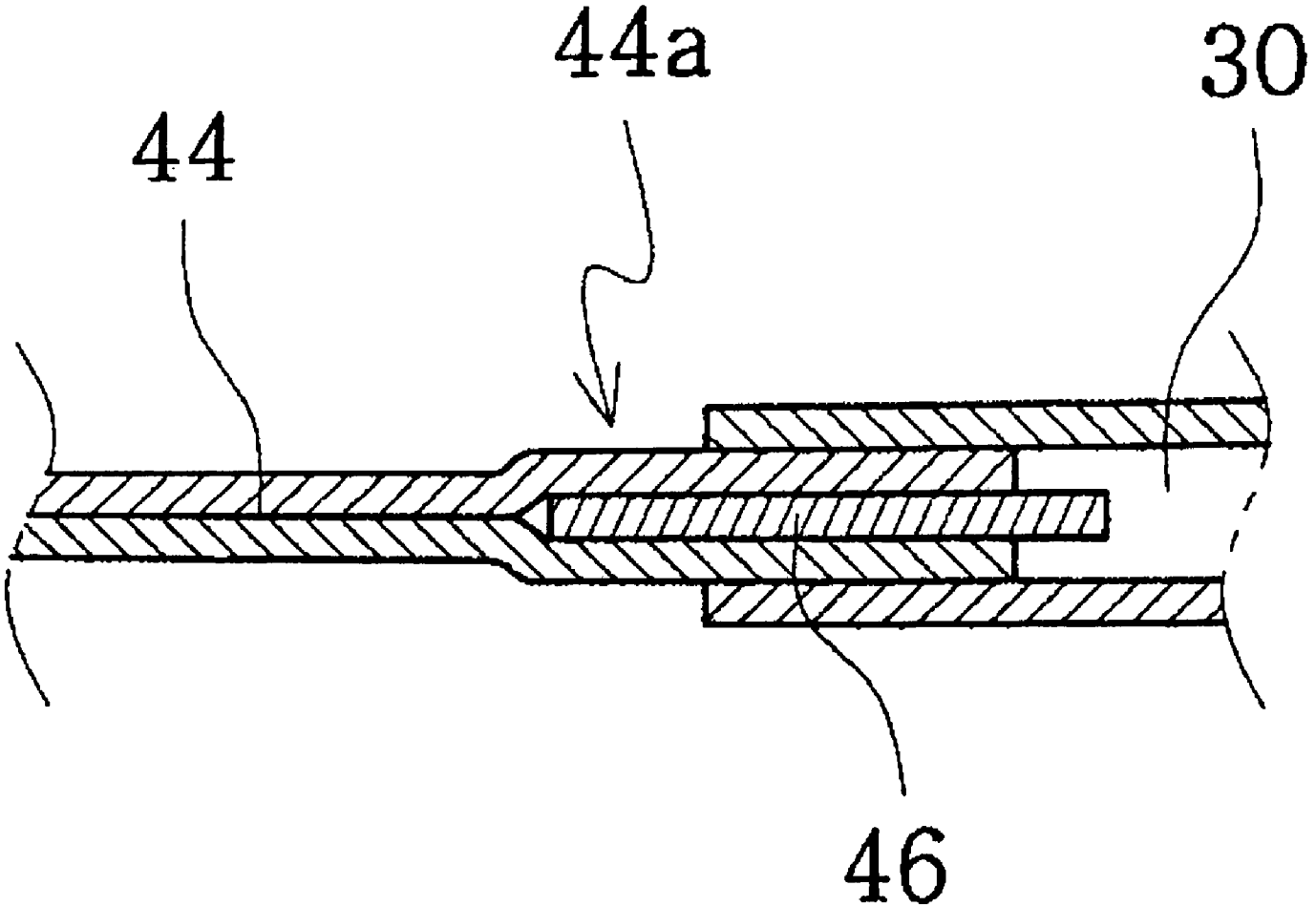
FIGS. 7A and 7B illustrate states of adhesion and non-adhesion between an insulator and a connection passage.
Figure 7B:
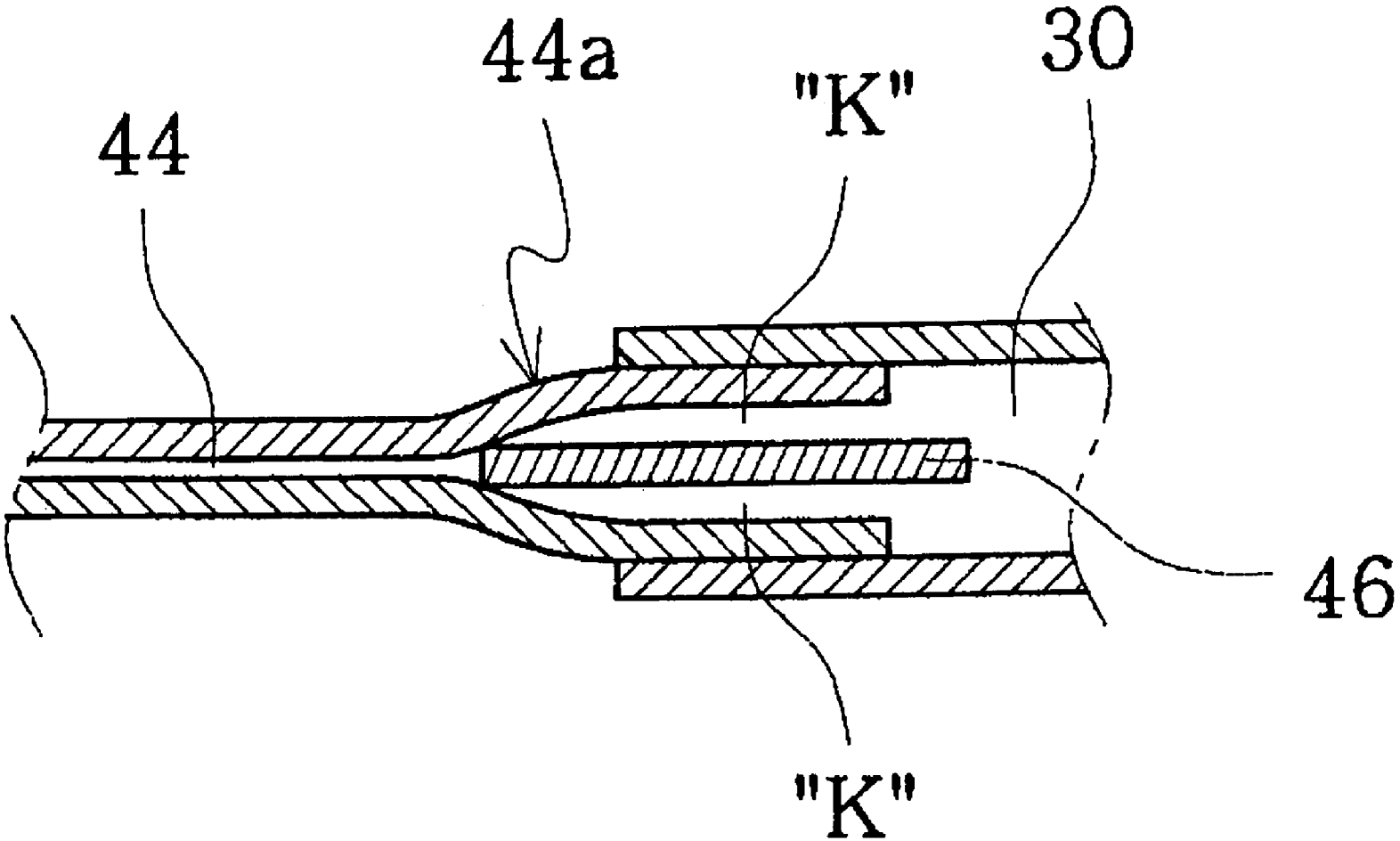

The insulator 46 also has a function of a check valve for allowing only one-way passage of air. As shown in FIGS. 7A and 7B, air is supplied to the air discharge tube 30 by the pumping operation of the air pump 22 and if so, aperture (K) is provided between the insulator 46 and the connection pipe 44 due to pressure of the supplied air. The air can be stored in the air chamber 48 via the connection pipe 44 through the aperture (K). Upon completion of the supplying of the air, the connection pipe 46 and its inlet port 44*a* are adhered to each other, thereby cutting off backward flowing of the air stored in the air chamber 48. This will be in more detail described in an operation description below.

Figure 4:
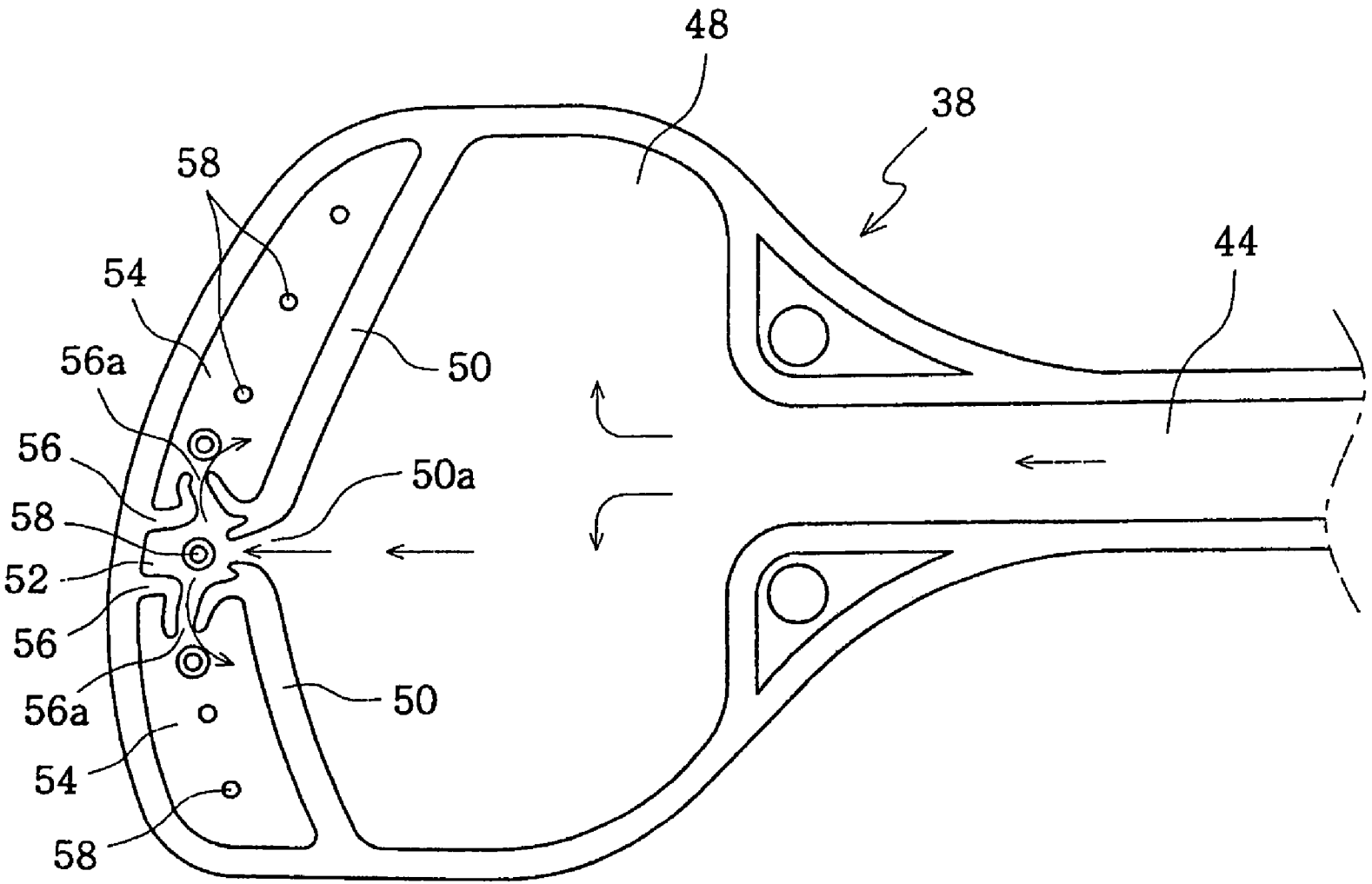
FIG. 4 is a plan view illustrating a portion of an air chamber provided at a cushion and ventilation device.

FIG. 4 is a detailed view illustrating the air chamber provided at the air tube.

As shown in FIG. 4, the air chamber 48 stores the air supplied through the connection pipe 44 for a predetermined time, and provides the cushion force to walker's feet, thereby cushioning impact.

In other words, if the air is introduced, depending on the pumping operation of the air pump 22, into the air chamber 48 through the connection pipe 44, the air chamber 48 is expanded and swelled out and, if the sole contacts the air chamber 48, the air chamber 48 is elastically pressed and the impact applied to the sole is cushioned.

A thermal bonding part 50 is provided in front of the air chamber 48, and separately partitions an auxiliary chamber 48*a*. The thermal bonding part 50 has a discharge passage 50*a* at its center such that the air stored in the air chamber 48 can pass the auxiliary chamber 48*a*.

The auxiliary chamber 48*a* is divided into three chambers: a central auxiliary chamber 52 communicating with the discharge passage 50*a*, and side auxiliary chambers 54 provided at both sides of the central auxiliary chamber 52 using auxiliary bonding parts 56. The auxiliary bonding parts 56 have branch passages 56*a*, respectively, and the branch passages 56*a* allow air stored in the central auxiliary chamber 52 to enter the side auxiliary chambers 54.

The side auxiliary chamber 54 has outlet ports 58 provided using its penetration. The outlet ports 58 discharge the air supplied to the central auxiliary chamber 52 and the side auxiliary chambers 54, into the shoe, preferably, between users toes, thereby embodying a ventilation effect.

In other words, that the air chamber 48 is thermally bonded using the thermal bonding part 50, and the separate auxiliary chambers 48*a* are provided to communicate with each other through the discharge passage 50*a* and the branch passage 56*a* is to maximally delay time taken to discharge the stored air of the air chamber 48 into the shoe, and maintain the cushion force of the air chamber 48 for a longer time.

Figure 5:
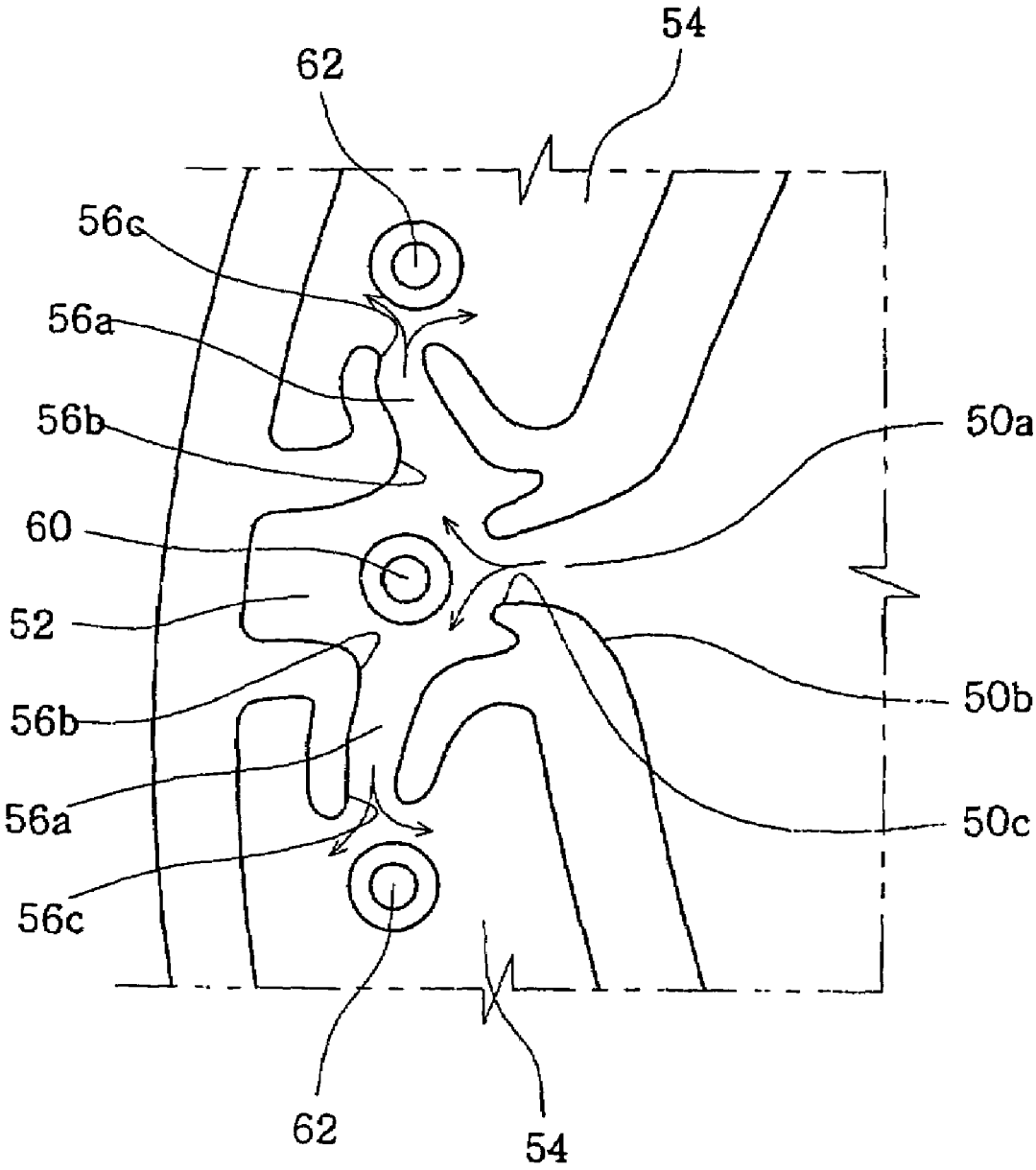
FIG. 5 is a detailed view illustrating a discharge passage and a branch passage provided at an air chamber and an auxiliary chamber.

FIG. 5 is a detailed view illustrating structures of the passage and the branch passage for supplying air into the air chamber and the auxiliary chamber.

As shown in FIG. 5, the discharge passage 50*a* communicating the air chamber 48 with the central auxiliary chamber 52 is provided to have a narrower diameter as going from an inlet port 50*b* to an outlet port 50*c*. This is to reduce a discharge speed of the air discharged from the air chamber 48 to the central auxiliary chamber 52, thereby holding the cushion force of the air chamber 48.

The branch passages 56*a* communicating the central auxiliary chamber 52 with the side auxiliary chambers 54 are manufactured to also have narrower diameters as going from the inlet port 56*b* to the outlet port 56*c*. This is also to reduce a discharge speed of the air discharged from the central auxiliary chamber 52 to the side auxiliary chambers 54, thereby forming an air chamber and providing a cushion part based on pressure remaining as much as a delay of the speed.

A spot thermal bonding part 60 is bonded to and provided at the central auxiliary chamber 52. The spot thermal bonding part 60 stably controls the discharge speed of air discharged to the central auxiliary chamber through the discharge passage 50*a*. In other words, air passing through one discharge passage is branched into two parts through the spot thermal bonding part, and is stored in the central auxiliary chamber, thereby stably controlling the discharge speed of the air. The stably controlling of the discharge speed of air means that the discharge speed of the air is reduced to the maximum.

In other words, the spot thermal bonding part 60 can control the discharge speed of the air depending on the bonding position. In detail, if the spot thermal bonding part 60 is disposed closely to the outlet port 50*c* of the discharge passage 50*a*, the outlet port 50*c* of the discharge passage 50*a* can be narrowed, thereby increasing a discharge pressure and thus, stabilizing the discharge speed of the air. On contrary, if the spot thermal bonding part 60 is disposed distantly away from the outlet port 50*c* of the discharge passage 50*a*, the outlet port 50*c* of the discharge passage 50*a* is widened, thereby increasing the discharge speed of the air.

Spot thermal bonding parts 62 are bonded to and provided even at the side auxiliary parts 54. The spot thermal bonding parts 62 stably control the discharge speed of the air that is discharged from the central auxiliary chamber 52 to the side auxiliary chambers 54 through the branch passage 56*a*. In other words, the air passing through the branch passages 56*a* is branched into two parts through the spot thermal bonding parts 62 and is stored in the side auxiliary chambers 54, thereby maximally delaying the discharge speed of the air. The spot thermal bonding part 62 can be provided to have a bonding position close to or distant away from the outlet port 56*c* of the branch passage 56*a*, thereby controlling the discharge speed of the air.

As a result, in the present invention, when the air discharged through one discharge passage 50*a* is introduced into the central auxiliary chamber 52, it is branched into two parts through the spot thermal bonding parts 60 and 62, and the stored air of the central auxiliary chamber 52 is again branched into four parts through two branch passages 56*a* and introduced into the side auxiliary chambers 54, thereby stably controlling the discharge speed of the air.

An operation of the ventilation shoe with the cushion and ventilation device according to the present invention will be described with reference to FIGS. 3 to 7B below.

First, a process of manufacturing the cushion and ventilation device 20, a main construction of the present invention, will be described.

As shown in FIG. 3, the air pump 22 and the air tube 38 are mainly provided in a separate manner and are thermally bonded at their connection parts using the microwave, thereby manufacturing the cushion and ventilation device 20.

First, the sponge 32 and the elastic member 36 are sequentially placed on the lower sheet 26 and then, the upper sheet 24 is overlapped thereon, thereby completing the air pump 22.

Next, after the air tube 38 having the connection pipe 44 and the air chamber 48 is manufactured in a pre-process, the inlet port 44*a* of the connection pipe 44 of the air tube 38 is partially inserted into the air discharge pipe 30 of the air pump 22 and then, the upper and lower sheets 24 and 26 of the air pump 22 are thermally bonded at their circumference surfaces using the microwave. Accordingly the air tube 38 and the air pump 22 are mutually bonded together, thereby completing the cushion and ventilation device 20.

By the insulator 46 fitted into the inlet port 44*a* of the connection passage 44 of the air tube 38, the inlet port 44*a* of the connection pipe 44 can be kept to be in an opened state without closure when the air pump 22 and the air tube 38 are bonded together.

An operation of the shoe with the above manufactured cushion and ventilation device 20 will be described.

Figure 6A:
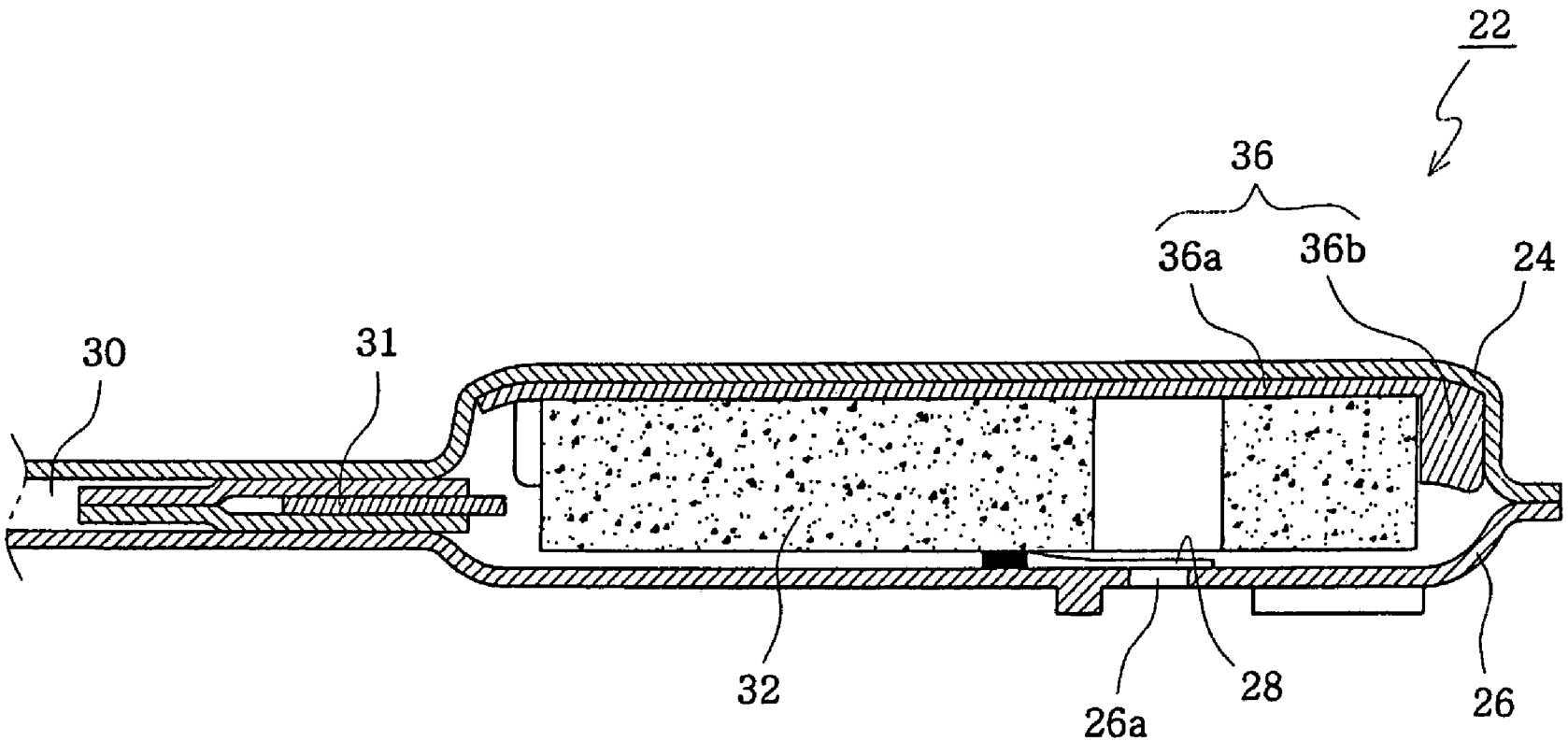
FIGS. 6A and 6B sequentially illustrate an operation of an air pump.
Figure 6B:
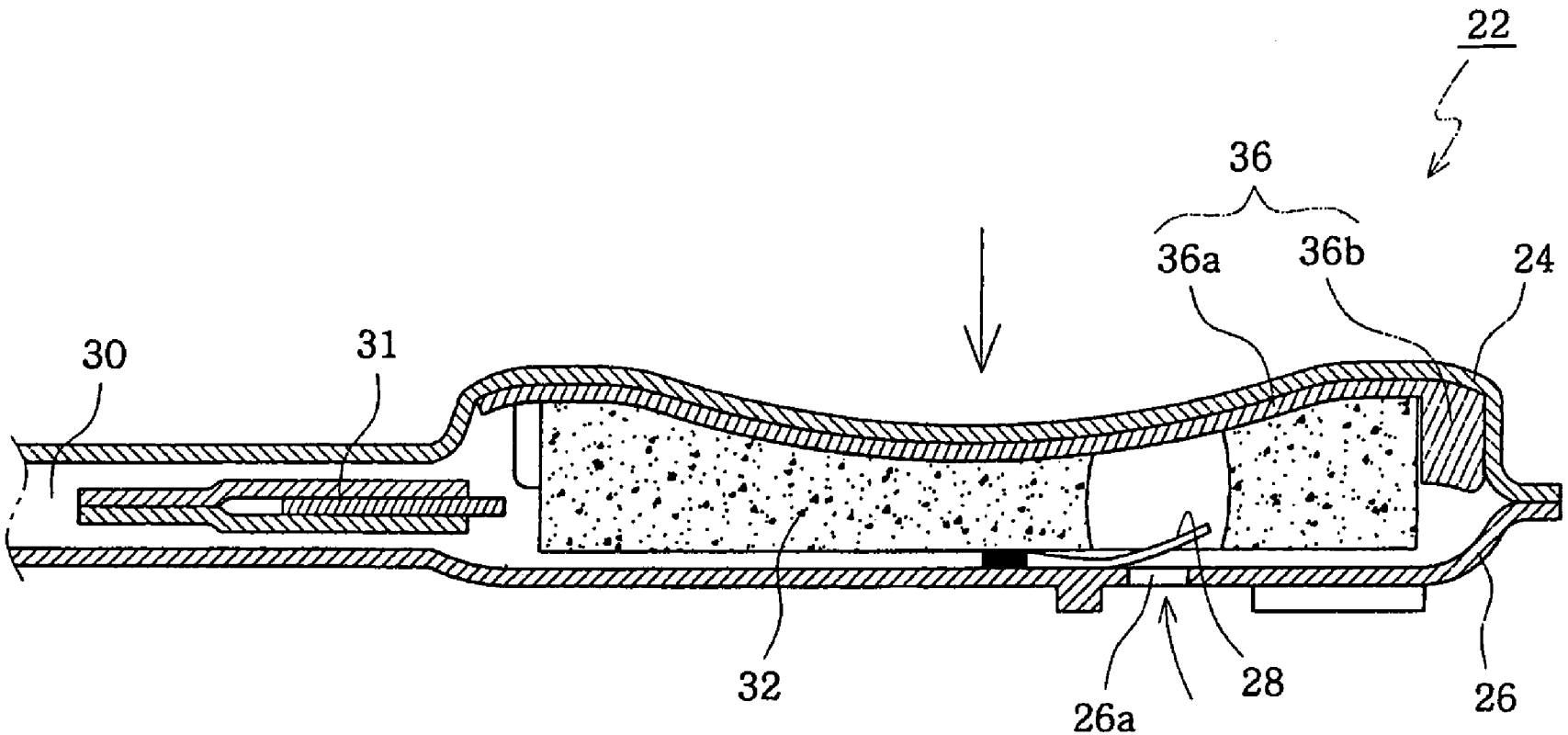

If a walker wears the shoe with the cushion and ventilation device 20 and begins to walk, as shown in FIGS. 6A and 6B, a rear foot portion (heel) first touches at the ground and, in this process, the air pump 22 is contracted and air is sucked through the intake hole 26*a*. Upon completion of the sucking of the air, the air pump 22 can be quickly restored to an initial state using the sponge 32 and the elastic member 36 for elastically supporting the sponge 32.

Next, after the air sucked into the air pump 22 is supplied to the air discharge tube 30, it is introduced into the connection pipe 44 inserted into the air discharge tube 30. At this time, the insulator 46 fitted into the inlet port 44*a* of the connection pipe 44 serves as the check valve and allows only one-way passage of air. In other words, as shown in FIGS. 7A and 7B, the apertures (K) are generated at top and bottom of the insulator 46, which is fitted into the inlet port 44*a* of the connection pipe 44, by pressure of the air supplied to the air discharge tube 30, and the air is introduced into the connection pipe 44 through the aperture (K). Upon completion of the introduction of air, the insulator 46 is again closely adhered at its top and bottom to the connection pipe 44, thereby preventing the backward flow of air. The air introduced into the connection pipe 44 is stored in the air chamber 48 subsequently.

After that, as shown in FIG. 4, when a walker's front foot portion (sole) contacts the air chamber 48, the pressure of the air stored in the air chamber 48 provides the cushion force, and the impact applied to the walker's sole is cushioned.

At the same time, after the air stored in the air chamber 8 is introduced into the central auxiliary chamber 52 through the discharge passage 50*a* owing to pressure applied from the sole, the air is introduced into the side auxiliary chamber 54 through the branch passage 56*a* and then, is introduced into the shoe through the outlet ports 58 provided at the side auxiliary chambers 54. In other words, the air stored in the air chamber 48 passes through a plurality of the auxiliary chambers 48*a* (from the central auxiliary chamber 52 to the side auxiliary chamber 54) via a plurality of the discharge passage 50*a* and the branch passages 56*a* and then, is introduced into the shoe, thereby delaying the discharge time of the air and maintaining the cushion force of the air chamber 48 for a long time.

As shown in FIG. 5 also, diameter sizes of the discharge passage 50*a* and the branch passages 56*a* get small as going from an inlet side to an outlet side, such that the discharge time of air can be delayed, the pressure can be increased, and the air can be stably discharged, thereby more efficiently delaying the cushion force of the air chamber 48.

When the air stored in the air chamber 48 is discharged to the central auxiliary chamber 52 and the side auxiliary chambers 54 through the discharge passage 50*a* and the branch passages 56*a*, the spot thermal bonding parts 60 and 62 thermally bonded to the central auxiliary chamber 52 and the side auxiliary chambers 56 can control the outlet port 50*c* of the discharge passage 50*a* and the outlet ports 56*c* of the branch passages 56*a*, thereby controlling the discharge time of air.

As described above, the shoe having the cushion and ventilation function according to the present invention achieves many effects in the following.

First, the present invention has an effect in that the restoring force of the air pump is prevented from being deteriorated due to the long-time pumping operation, thereby smoothly promoting the pumping operation of the air pump.

Further, the present invention has an effect in that the cushion and ventilation device including the air pump, and the air discharge tube and the air tube, can be manufactured using a one-time microwave based thermal bonding method, thereby simplifying a work process, and the inlet port of the connection passage can be prevented from being closed in the bonding process, using the insulator.

Furthermore, the present invention has an effect in that the air stored in the air tube is delayed to the maximum and discharged into the shoe, thereby maintaining the cushion force for a longer time.

Furthermore, the present invention has an effect in that the discharged air can be concentrated on and supplied to the sweaty portion.

While the present invention has been described with reference to exemplary embodiments thereof, it will be apparent to those skilled in the art that various modifications can be made therein without departing from the spirit and scope of the invention as defined by the appended claims and their equivalents.

What is claimed is:

1. A shoe with a cushion and ventilation device, comprising:

uppers forming an external shape; and a sole forming a bottom of the uppers and having a cushion and ventilation device;

the cushion and ventilation device comprising:

an air pump having an air discharge tube provided at its one side; and an air tube having a connection pipe connecting to the air discharge tube of the air pump and an air chamber;

wherein the air pump is provided by placing an upper sheet having a cavity on a lower sheet having an intake hole, and thermally bonding circumference surfaces of the upper and lower sheets;

wherein the upper and lower sheets further comprise a sponge having contraction and restoring forces therein;

wherein the upper and lower sheets further comprise an elastic member placed on the sponge and having elastic protrusion parts extended along a circumference surface thereof.

2. The shoe according to claim 1, wherein an insulator formed of different material from the air tube is fitted into an inlet port of the connection pipe provided at the air tube.

3. The shoe according to claim 2, wherein an auxiliary chamber for discharging air into the shoe is partitioned by a thermal bonding part and provided in front of the air chamber, and wherein the auxiliary chamber communicates with a discharge passage provided at a center of the thermal bonding part.

4. The shoe according to claim 3, wherein the discharge passage is narrowed as going from an inlet side to an outlet side.

5. The shoe according to claim 4, wherein the auxiliary chamber is divided into a central auxiliary chamber communicating with the discharge passage, and side auxiliary chambers positioned at both sides of the central auxiliary chamber, and partitioned by auxiliary thermal bonding parts from the central auxiliary chamber and, in a partitioned state, communicating with the central auxiliary chamber through branch passages provided at the auxiliary thermal bonding parts.

6. The shoe according to claim 5, wherein the branch passages are narrowed as going from the inlet side to the outlet side.

7. The shoe according to claim 5, wherein spot thermal bonding parts are bonded and provided in the central auxiliary chamber and the side auxiliary chambers.

8. A footwear comprising:

an upper forming an exterior shape of a footwear;

a sole forming a bottom of the upper; and a cushion and ventilation device, the cushion and ventilation device comprising:

an air pump having an air discharge tube provided at its one side; an air tube having a connection pipe connecting to the air discharge tube of the air pump; and an air chamber having an end connecting to the air tube and an enlarged area for storing air supplied from the air pump;

wherein the air pump includes an upper sheet and a lower sheet coupled to each other and forming a cavity between the upper and lower sheets, the lower sheet having an intake hole;

wherein the air pump further includes an elastic element received in the cavity between the upper and lower sheets.

9. The footwear according to claim 8, wherein the elastic element includes a sponge material with contracting and restoring properties disposed in the cavity of the air pump.

10. The footwear according to claim 9, wherein the elastic element includes another elastic member placed on the sponge material for enhancing the restoring of the sponge material.

11. The footwear according to claim 10, wherein the other elastic member placed on the sponge material includes a planar part and a plurality of elastic protrusion parts extending along a circumference surface of the planar part.

12. The footwear according to claim 8, wherein an insulator is fitted into an inlet port of the connection pipe.

13. The footwear according to claim 8, wherein the air chamber has an auxiliary chamber connected thereto and for discharging air into the footwear.

14. The footwear according to claim 13, wherein the auxiliary chamber is divided from the air chamber by a partitioning part, the partitioning part having a discharge passage at a central area thereof, and the auxiliary chamber being in fluid communication with the air chamber via the discharge passage.

15. The footwear according to claim 14, wherein the auxiliary chamber is divided into a central auxiliary chamber communicating with the discharge passage, and side auxiliary chambers positioned at lateral sides of the central auxiliary chamber.

16. The footwear according to claim 15, wherein the side auxiliary chambers are partitioned by auxiliary partitioning parts from the central auxiliary chamber, the side auxiliary chambers in fluid communication with the central auxiliary chamber through branch passages provided at the auxiliary partitioning parts.

17. The footwear according to claim 16, wherein the partitioning part and the auxiliary partitioning parts are thermal bonding parts.

18. The footwear according to claim 16, wherein the discharge passage and the branch passages are narrowed as going from the inlet side to the outlet side thereof.

* * * * *